US006506269B2

(12) United States Patent
Liu et al.

(10) Patent No.: US 6,506,269 B2
(45) Date of Patent: Jan. 14, 2003

(54) HIGH-STRENGTH AND HIGH-CONDUCTIVITY CU-(NI, CO, FE)-SI COPPER ALLOY FOR USE IN LEADFRAMES AND METHOD OF MAKING THE SAME

(75) Inventors: Jin-Yaw Liu, Hsinchu (TW); Yu-Lian Sha, Yeong-Ho (TW); I-Ching Lee, Hua-Lien (TW); Mao-Ying Teng, Hsinchu (TW); Ray-Iun Liu, Hsinchu (TW); Ren-Der Jean, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 09/961,481

(22) Filed: Sep. 21, 2001

(65) Prior Publication Data

US 2002/0029827 A1 Mar. 14, 2002

Related U.S. Application Data

(62) Division of application No. 09/232,178, filed on Jan. 15, 1999, now abandoned.

(51) Int. Cl.[7] ..... C22F 1/08

(52) U.S. Cl. ..... 148/554; 148/567; 148/574; 148/682

(58) Field of Search ..... 148/554, 567, 148/574, 682

(56) References Cited

FOREIGN PATENT DOCUMENTS

JP 09020943 * 1/1997

* cited by examiner

*Primary Examiner*—Sikyin Ip
(74) *Attorney, Agent, or Firm*—W. Wayne Liauh

(57) ABSTRACT

A high-strength and high-conductivity copper alloy is disclosed which contains essentially of: (a) from 0.5 to 2.5 wt % of Ni; (b) from 0.5 to 2.5 wt % of Co; (c) from 0.5 to 0.8 wt % of Si; (d) from 0.05 to 0.15 wt % of either Mg or P or both; and (e) the balance of Cu. The amounts of Co, Ni, and Si satisfy the following equations: $2\% \leqq (Ni+Co) \leqq 4\%$, and $0.8 \leqq (Ni/4+Co/6)/Si \leqq 1.2$. The new copper alloy exhibits substantially improved electrical conductivity, greater than 65% IACA, than the commercially available C7025 copper alloy, while maintaining a satisfactory tensile strength (greater than 600 MPa), and, thus, can be most advantageously used for preparing leadframes for use in high pin-number (greater than 100 pins) IC application.

6 Claims, 2 Drawing Sheets

HIGH-STRENGTH AND HIGH-CONDUCTIVITY CU-(NI, CO, FE)-SI COPPER ALLOY FOR USE IN LEADFRAMES AND METHOD OF MAKING THE SAME

This is divisional application of application Ser. No. 09/232,178 filed Jan. 15, 1999, now abandoned.

FIELD OF THE INVENTION

The present invention relates to an improved copper alloy for use in the integrated-circuit (IC) industry. More specifically, the present invention relates to an improved copper alloy which exhibits high strength as well as high conductivity so that it can be most advantageously utilized in many task specific applications such as making leadframes and other thin conducting components for high pin-number IC applications.

BACKGROUND OF THE INVENTION

Copper alloys are one of the most important and ubiquitous elements in the fabrication of integrated-circuits (IC). With the rapid development of the computer and communication technology, the IC industry is experiencing an unprecedented expansion. This leads to increased demand on the quantity and quality of IC packaging technology. One of the key elements in the IC packaging technology is to develop improved leadframes to provide high quality electrical communication into and out of the semiconductor devices contained in the IC chip.

Leadframes are bridges that provide communications for electrical signals among different parts of an IC board. In addition to transporting electrical signals, leadframes also provide an important function allow efficient dissipation of heat that will be generated during the busy flow of electrons. As the trend in the IC industry is to become more highly integrated, the lines become finer, the frequency gets higher, and the cost continues to be lowered, many associated changes are also taking place. For example, plastics has taken the place of ceramics and the leadframe materials are changed from Fe—Ni alloys to copper alloys.

A number of copper alloys have been developed for fabricating leadframes and various other applications. At the present time, there are at least sixty different commercially available copper alloys for making leadframes. Generally speaking, the copper alloys can be divided into three categories: (1) high conductivity, typically with a conductivity greater than 80% IACS, but with a tensile strength lower than 400 MPa; (2) medium-to-high conductivity and medium strength, typically with a conductivity greater than 50% IACS and a tensile strength between 400 and 500 MPa; and (3) high strength, typically for use in making leadframes for IC's with 100 or more pins. The third type copper alloys typically have a tensile strength greater than 600 MPa but electrical conductivity of 35% IACS or higher.

The first type is commonly used in making leadframes for use in transistors. Examples of the first type copper alloys include C19210 (KFK, TAMAC4), C15100 (HCL-151, Mitsubishi C151, ZC2, etc.), C18030 (EFTEC6), etc. Examples of the second type include C19400 (Olin C194, TAMAC194, HCL194, KLF194), C18040 (EFTEC64), C19500, C19600, TAMAC5, EFTEC5, etc.; the constitute the bulk of copper alloys for making leadframes for ICs. And examples of the third type include C7025 and KLF125. Several patents discussed the C7025 alloys, these include: U.S. Pat. Nos. 4,594,221, and 4,729,372, and Taiwan Patent No. 120,435.

The following U.S. patents provide some background information on copper alloys.

U.S. Pat. No. 4,950,451 discloses and claims a copper alloy for an electronic device consisting essentially of 1.0 wt %–4.0 wt % of Ni, more than 0.2 wt % and less than 0.8 wt % of P, 0.5 wt %–6.0 wt % of Zn, 0.05 wt %–1.0 wt % of Mg, and the rest being copper and unavoidable impurties.

U.S. Pat. No. 5,064,611 discloses an claims a method for producing a copper alloy, which comprises steps of: quenching to solidify, at a cooling rate in the range from 100° C./sec to 100,000° C./sec, a molten metal consisting essentially of 1.0 to 8 wt % of Ni, 0.1 to 0.8 wt % of P, 0.06 to 1.0 wt % of Si, and a remainder of Cu and unavoidable impurities; and continuously cooling in succession said solidified metal to normal temperature to cause an intermetallic compound of Ni—P and Ni—Si to be finely and uniformed into the matrix material.

U.S. Pat. No. 5,215,711 discloses and claims an age-hardening copper alloy consisting of: (1) copper; (2) 1–2.5 wt % of Ni; (3) from more than 0.01 wt % to less than 7 wt % of Si; (4) from more than 0.01 wt % to less than 10 wt % of Fe; (5) from more than 0.01 wt % to less than 7 wt % of Ti; and (6) from more than 0.001 wt % to less than I wt % of B; wherein the amount of copper constitutes the balance of the weight of the alloy.

U.S. Pat. No. 5,248,351 discloses and claims a copper alloy for an electronic device which consists essentially of 2.0 wt %–8 wt % of Ni, 0.1 wt %–0.8 wt % of P, 0.06–I wt % of Si, and the rest being Cu and unavoidable impurties, wherein the weight of Ni, P+Si is within the range fo from 4.12: 1 to 6.06: 1; and wherein $Ni_5P_2$nd $Ni_2Si$ intermetallic compounds are present.

U.S. Pat. No. 5,250,256 discloses and claims a high-tensile copper alloy for current conduction consisting essentially of: (1) from 2.0 wt % to 4.0 wt % of Ni; (2) from 0.4 wt % to 1.0 wt % of Si; (3) 0.05 wt % to 0.3 wt % of In; (4) from 0.01 wt % to 0.2 wt % of Co; and (5) the balance of Cu.

U.S. Pat. No. 5,334,346 discloses and claims a copper alloy having high strength, enhanced ductility, and good electrical conductivity consisting essentially of (1) from about 0.5 wt % to 2.4 wt % nickel; (2) from 0.1 wt % to 0.5 wt % silicon; (3) from 0.02 wt % to 0.16 wt % phosphorus; (4) from 0.02 wt % to 0.2 wt % magnesium; and (5) the balance copper.

A number of Japanese patents also discussed copper alloys. These include JP-7-18356, JP-4-356284, JP-7-18355, JP-2522629, JP-2705875, JP-6-299275, JP-6-172895, JP-5-331574, JP-6-128708, JP-8-503022, JP-7-62504.

As discussed earlier, C7025 alloy provides medium conductivity as well as high strength. A typical C7025 alloy, as disclosed in Taiwan Pat. No. 120435, can exhibit the same kind of strength as Fe-42 Ni alloy, however, its electrical conductivity is more than 10 times better than the 42 alloy. However, its electrical conductivity can only reach 35 to 50% IACS at the maximum Because of the significance of leadframes and other electric current conducting devices in the IC industry, both commercially and technologically speaking, it is important to continue the development of other types of copper alloys which can further improve the performance and lower the cost of electronic devices.

SUMMARY OF THE INVENTION

The primary object of the present invention is to develop an improved copper alloy for use in preparing IC devices.

More specifically, the primary object of the present invention is to develop an improved copper alloy with both improved strength and improved conductivity, so as to satisfy today's need for high-conductivity and high-strength leadframes which have become a critical element in today's IC packaging applications.

The copper alloy disclosed in the present invention consists essentially of Ni, Co, Si, (Mg and/or P), and Cu. The amount of Ni is from 0.5 to 2.5 wt %, the amounts of Co, Ni, and Si satisfy the following equation: $0.8 \leqq (Ni/4+Co/6)/Si \leqq 1.2$, the amount of (Mg and/or P) is from 0.05 to 0.15 wt %, with the balance being Cu. Furthermore, it is preferred that $2\% \leqq Ni+Co \leqq 4\%$. The copper alloy of the present invention is classified, similar to C7025 alloy, as belonging to the third type copper alloy with high electrical conductivity and high strength. However, the copper alloy of the present invention exhibits unexpected superior results in that its electrical conductivity exceeds the values of 35 to 50% IACS provided by C7025, while providing the same or even better tensile strength.

In the preferred embodiment of the present invention, the copper alloy consists essentially from 0.5 to 2.5 wt % of Ni, from 0.5 to 2.5 wt % of Co, from 0.4 to 0.8 wt % of Si, from 0.05 to 0.15 wt % of (Mg and/or P), and the balance of Cu, wherein the sum of Ni and Co is between 2.0 and 4.0 wt %.

There are two alternative approaches to fabricate the copper alloy plates or strips of the present invention: a high-temperature approach and a cold-temperature.

With the high-temperature approach, copper alloys having appropriate compositions are melt using a high frequency induction furnace and then cast by rapid cooling to form ingots of desired sizes. The hot ingots are homogenized at 800 to 950° C. for about ½ to 5 hours, then are immediately subjected to hot working to a rate of 70% or greater (i.e., its thickness is reduced by 70% or greater), followed by water quenching and then milled to remove oxide and scales. The alloy plates so obtained are subject to cold rolling (cold working) to a thickness reduction of 50% or greater, followed by annealing at 800 to 950° C. for 30 seconds to 30 minutes, then they are rapidly cooled. Thereafter, the alloy plates are cold rolled again to 50% or above. The steps of annealing and cold rolling can be repeated if necessary. After the cold rolling, the alloy plates are subjected to heat aging treatment at 300 to 600° C. for 30 minutes to 5 hours, to obtain the desired strength and current conductivity. If necessary, the aged copper alloy strips can be further subject to a small amount of cold working; however, the amount of the additional cold working should be less than 40%.

With the low-temperature approach, copper alloys having appropriate compositions are melt using a radio frequency oven and then cast by rapid cooling to form ingots of desired sizes. The hot ingots are homogenized at 800 to 950° C. for about ½ to 5 hours, then are immediately subjected to hot working to a reduction ratio of at least 70% in thickness, followed by water quenching and then milled to remove oxide and scales. Thereafter, the copper plates are cold rolled a cold reduction ratio of 50% of greater in thickness, followed by aging at 300 to 600° C. The steps of cold working and aging may be repeated so as to obtain the desired strength and current conductivity. If necessary, the aged copper alloy strips can be further subject to a small amount of cold working; however, the amount of the additional cold working should be less than 40%.

The copper alloys prepared from either process exhibits excellent electrical conductivity and tensile strength, and thus, can be advantageously used for the fabrication of leadframes for use in semiconductor industries.

BRIEF DESCRIPTION OF THE DRAWING

The present invention will be described in detail with reference to the drawing show preferred embodiment of the present invention, wherein.

DETAILED DESCRIPTION OF THE PREFERRED EMBODIMENT

Figure 1A:
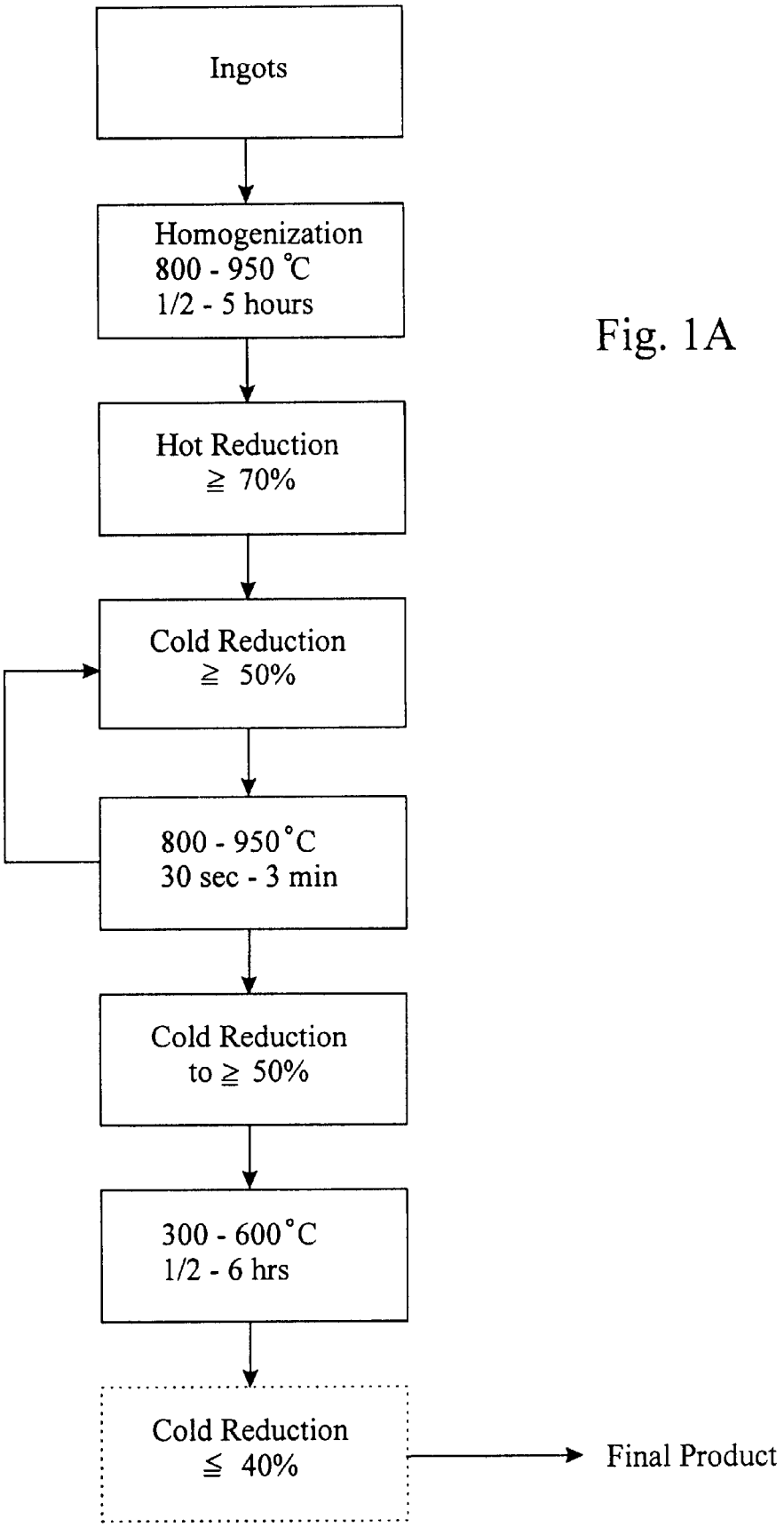
FIG. 1A is schematic flowchart diagram showing the main steps according to the high-temperature approach of the present invention.
Figure 1B:
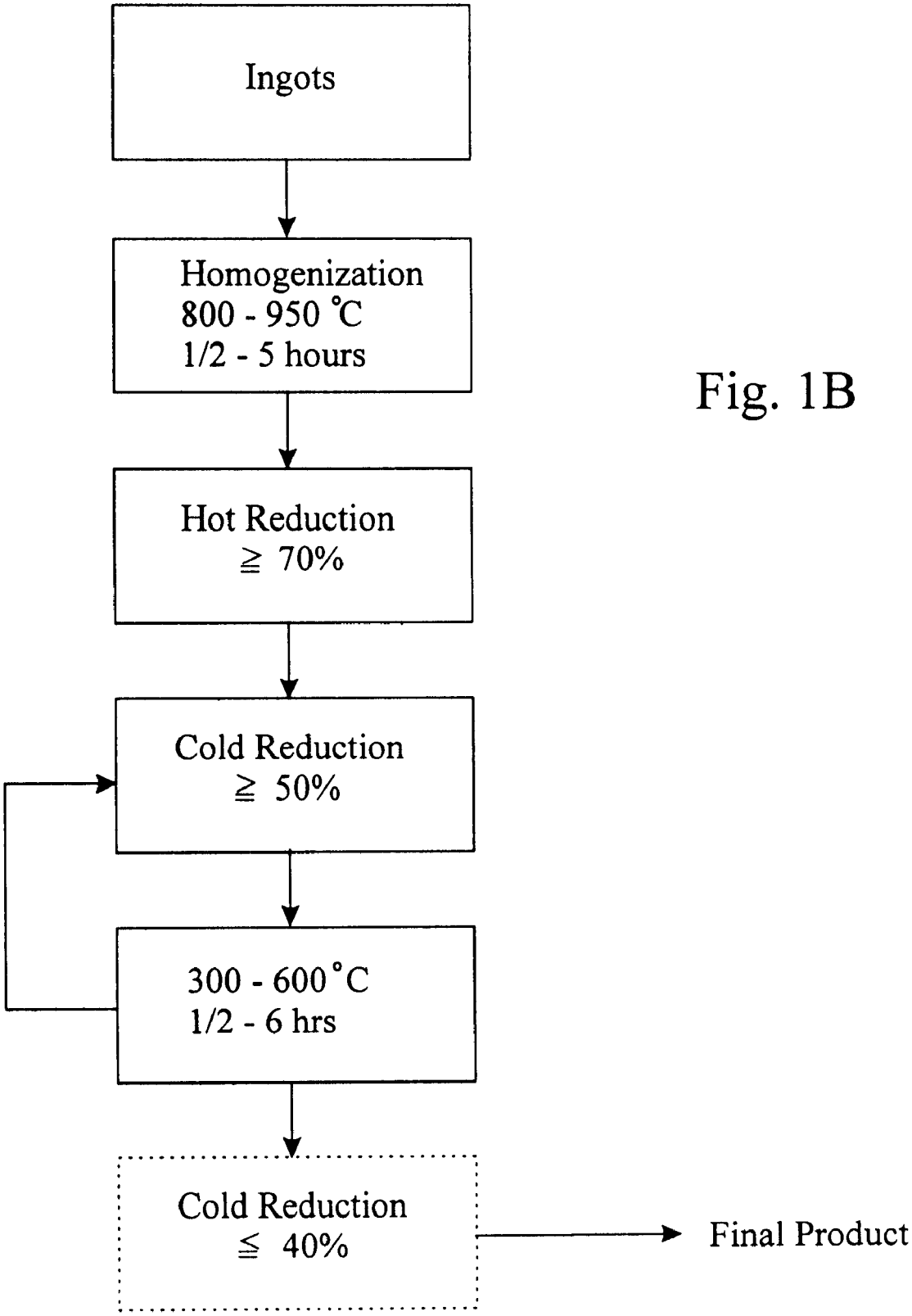
FIG. 1B is schematic flowchart diagram showing the main steps according to the low-temperature approach of the present invention.

The present invention discloses an improved copper alloy which exhibits excellent tensile strength as well as current conductivity thus can be advantageously used for fabricating leadframes which have become a critical element in today's IC packaging applications. Unexpected results were observed when the copper alloy was prepared according to a specific formulation. The tensile strength of the new copper alloy of the present invention compares favorably relative to that of C7025, a type III copper alloy, while it provides substantially improved electrical conductivity.

The copper alloy disclosed in the present invention consists essentially of:

(a) from 0.5 to 2.5 wt % Ni;

(b) from 0.5 to 2.5 wt % Co;

(c) from 0.5 to 0.8 wt % Si;

(d) from 0.05 to 0.15 wt % of either Mg or P or both; and (e) the balance Cu;

(f) wherein the amounts of Co, Ni, and Si satisfy the following equations: $2\% \leqq (Ni+Co) \leqq 4\%$, and $0.8 \leqq (Ni/4+Co/6)/Si \leqq 1.2$.

In the preferred embodiment of the present invention, which is designated as the Cu—Ni—Co series, the copper alloy consists essentially from 0.5 to 2.5 wt % of Ni, from 0.5 to 2.5 wt % of Co, from 0.4 to 0.8 wt % of Si, from 0.05 to 0.15 wt % of (Mg and/or P), and the balance of Cu, wherein the sum of Ni and Co is between 2.0 and 4.0 wt %.

Depending on the type of applications, the copper alloys of the present invention can be fabricated using either a high-temperature approach or a cold-temperature approach. With the high-temperature approach, copper alloys having appropriate compositions are melt using a high frequency induction furnace and then cast by rapid cooling to form ingots of desired sizes. The hot ingots are homogenized at 800 to 950° C. for about ½ to 5 hours, then are immediately subjected to hot working to a rate of 70% or greater (i.e., its thickness is reduced by 70% or greater), followed by water quenching and then milled to remove oxide and scales. The alloy plates so obtained are subject to cold rolling (cold working) to a thickness reduction of 50% or greater, followed by annealing at 800 to 950° C. for 30 seconds to 30 minutes, then they are rapidly cooled. Thereafter, the alloy plates are cold rolled again to 50% or above. The steps of annealing and cold rolling can be repeated if necessary. After the cold rolling, the alloy plates are subjected to heat aging treatment at 300 to 600° C. for 30 minutes to 5 hours, to obtain the desired strength and current conductivity. If necessary, the aged copper alloy strips can be further subject to a small amount of cold working; however, the amount of the additional cold working should be less than 40%.

With the low-temperature approach, copper alloys having appropriate compositions are first similarly melt using a radio frequency oven and then cast by rapid cooling to form ingots of desired sizes. The hot ingots are homogenized at 800 to 950° C. for about ½ to 6 hours, then are immediately subjected to hot working to a rate of at least 70%, followed by cold working (i.e., cold rolling) to achieve a cold reduction of at least 40%, and then precipitate hardening and again at 300 to 600° C. The steps of cold working and aging may be repeated so as to obtain the desired strength and current conductivity. If necessary, the aged copper alloy strips can be further subject to a small amount of cold working; however, the amount of the additional cold working should be less than 40%.

The present invention will now be described more specifically with reference to the following examples. It is to be noted that the following descriptions of examples, including the preferred embodiment of this invention, are presented herein for purposes of illustration and description, and are not intended to be exhaustive or to limit the invention to the precise form disclosed.

Examples 1–6

Cu—Ni—Co Series Copper Alloys

Copper alloys containing the compositions described in Table I A were prepared using both the high-temperature approach (I) and the low-temperature approach (II). The amounts of individual atoms are expressed in weight percent (wt %).

TABLE 1A

| | Cu | Ni | Co | Si | Mg | P |
|---|---|---|---|---|---|---|
| Example 1 | Bal. | 1.86 | 0.66 | 0.56 | 0.09 | — |
| Example 2 | Bal. | 0.99 | 1.16 | 0.55 | — | 0.096 |
| Example 3 | Bal. | 1.99 | 0.99 | 0.62 | — | 0.11 |
| Example 4 | Bal. | 1.49 | 1.46 | 0.58 | — | 0.10 |
| Example 5 | Bal. | 0.60 | 2.37 | 0.62 | — | 0.099 |
| Example 6 | Bal. | 0.98 | 1.48 | 0.52 | — | 0.096 |

The copper alloy plates so obtained were tested for their hardness, current conductivity, tensile strength, elongation. The test results are reported for the copper alloys before and after the additional 10% cold working, in Tables 1B and 1C, respectively; in both cases the copper alloys had been subject to aging heat treatment.

TABLE 1B

| | Hardness (Hv) | | Conductivity (% IACS) | | Tensile Strength (MPa) | | Elongation (%) | |
|---|---|---|---|---|---|---|---|---|
| Process | I | II | I | II | I | II | I | II |
| Example 1 | 212 | 257 | 46.8 | 51.5 | 708 | 851 | 8.80 | 4.45 |
| Example 2 | 190 | 210 | 46.3 | 53.7 | 604 | 677 | 9.07 | 4.24 |
| Example 3 | 216 | 204 | 47.2 | 63.2 | 641 | 635 | 7.16 | 7.035 |
| Example 4 | 201 | 200 | 48.1 | 68.7 | 629 | 624 | 8.44 | 6.465 |
| Example 5 | 179 | 202 | 54.9 | 63.8 | 589 | 668 | 6.26 | 5.994 |
| Example 6 | 187 | 211 | 51.0 | 58.6 | 614 | 669 | 11.1 | 7.54 |

TABLE 1C

| | Hardness (Hv) | | Conductivity (% IACS) | | Tensile Strength (MPa) | | Elongation (%) | |
|---|---|---|---|---|---|---|---|---|
| Process | I | II | I | II | I | II | I | II |
| Example 1 | 211 | 233 | 51.9 | 5303 | 709 | 905 | 10.81 | 3.07 |
| Example 2 | 193 | 212 | 46.5 | 49.7 | 623 | 727 | 8.32 | 3.49 |
| Example 3 | 209 | 203 | 48.4 | 56.5 | 704 | 705 | 7.16 | 4.00 |
| Example 4 | 197 | 194 | 49.2 | 65.3 | 682 | 705 | 5.69 | 4.41 |
| Example 5 | 181 | 209 | 52.5 | 66.5 | 600 | 651 | 6.73 | 3.25 |
| Example 6 | 183 | 205 | 50.8 | 55.4 | 623 | 730 | 6.125 | 4.11 |

For comparable commercial products, such as C7025 and KLF125, the hardness, conductivity, tensile Strength, and elongation would be 190–200 Hv, 35–50% IACS, 600–660 Mpa, and 6% elongation, respectively. Thus, the copper alloys of the present invention clearly exhibit superior conductivity and tensile strength than those of commercial products.

Comparative Example

The copper alloy plate was prepared from C7025 alloy, a commercially available copper alloy commonly used in the fabrication of high pin-number ICs. The copper alloy plate was for its hardness, current conductivity, tensile strength, elongation. The composition of the C7025 alloy is listed in Table 2A, and the test results are reported in Table 2B. The specimens of the test materials shown in Table 2B were cold rolled 30% after the final aging treatment.

TABLE 2A

| | Cu | Ni | Co | Fe | Si | Mg | P |
|---|---|---|---|---|---|---|---|
| Comp. Exam. | Bal. | 3.03 | — | — | 0.71 | 0.17 | — |

TABLE 2B

| | Hardness (Hv) | | Conductivity (% IACS) | | Tensile Strength (MPa) | | Elongation (%) | |
|---|---|---|---|---|---|---|---|---|
| Process | I | II | I | II | I | II | I | II |
| Comp. Exam. | — | — | 46.1 | 38.7 | 696 | 970 | 2 | 2 |

The above results show that the copper alloy of the present invention provides substantially higher conductivity (better than 45% IACS) than the commercially available type 3 copper alloy, while maintaining satisfactory tensile strength (greater than 600 MPa) for high-pin-number ICs.

The foregoing description of the preferred embodiments of this invention has been presented for purposes of illustration and description. Obvious modifications or variations are possible in light of the above teaching. The embodiments were chosen and described to provide the best illustration of the principles of this invention and its practical application to thereby enable those skilled in the art to utilize the invention in various embodiments and with various modifications as are suited to the particular use contemplated. All such modifications and variations are within the scope of the present invention as determined by the appended claims when interpreted in accordance with the breadth to which they are fairly, legally, and equitably entitled.

What is claimed is:

1. A process for preparing copper alloy comprising the following steps:

(a) preparing a metal mixture consisting essentially of
(i) from 0.5 to 2.5 wt % of Ni;
(ii) from 0.5 to 2.5 wt % of Co;
(iii) from 0.5 to 0.8 wt % of Si;
(iv) from 0.05 to 0.15 wt % of either Mg or P or both; and
(v) the balance of Cu;
(vi) wherein the amounts of Co, Ni, and Si satisfy the following equation:

$$2\% \leqq (Ni+Co) \leqq 4\%,$$

and $$0.8 \leqq (Ni/4+Co/6)/Si \leqq 1.2,$$

(b) melting constituting metals using a high frequency induction furnace followed by rapid cooling to form ingots of desired sizes;

(c) homogenizing said ingots at about 800 to 950° C. for about ½ to 5 hours;

(d) hot working said homogenized ingots to form copper alloy plate at a hot reduction ratio of 70% or greater in thickness, followed by water quenching and then milled to remove oxide and scales;

(e) cold rolling said copper alloy plate to a thickness reduction of 50% or greater, followed by annealing at about 800 to 950° C. for 30 seconds to 30 minutes then rapidly cooling said copper alloy plate;

(f) cold rolling said copper alloy plate to a thickness reduction of 50% or greater; and (g) aging said copper alloy plates at about 300 to 600° C. for 30 minutes to 5 hours.

2. The process for preparing copper alloy according to claim 1 wherein said metal mixture consists essentially of: from 0.5 to 2.5 wt % of Ni, from 0.5 to 2.5 wt % of Co, from 0.5 to 0.8 wt % of Si, from 0.05 to 0.15 wt % of (Mg and/or P), and the balance of Cu, wherein the sum of Ni and Co is between 2.0 and 4.0 wt %.

3. The process for preparing copper alloy according to claim 1, which further comprises the step of subjecting said copper alloy plate to additional cold rolling after aging.

4. A process for preparing copper alloy comprising the following steps:

(a) preparing a metal mixture consisting essentially of:
(i) from 0.5 to 2.5 wt % of Ni;
(ii) from 0.5 to 2.5 wt % of Co;
(iii) from 0.5 to 0.8 wt % of Si;
(iv) from 0.05 to 0.15 wt % of either Mg or P or both; and
(v) the balance of Cu;
(vi) wherein the amounts of Co, Ni, and Si satisfy the following equations:

$$2\% \leqq (Ni+Co) \leqq 4\%,$$

and $$0.8 \leqq (Ni/4+Co/6)/Si \leqq 1.2,$$

(b) melting constituting metals using a high frequency induction furnace followed by rapid cooling to form ingots of desired sizes;

(c) homogenizing said ingots at about 800 to 950° C. for about ½ to 5 hours;

(d) hot working said homogenized ingots to form copper alloy plates at a reduction ratio of 70% or greater in thickness, followed by water quenching and then milled to remove oxide and scales;

(e) cold rolling said copper alloy plates to a cold reduction of 50% or greater; and (f) aging said copper alloy plates at about 300 to 600° C.

5. The process for preparing copper alloy according to claim 4 wherein said metal mixture consists essentially of: from 0.5 to 2.5 wt % of Ni, from 0.5 to 2.5 wt % of Co, from 0.5 to 0.8 wt % of Si, from 0.05 to 0.15 wt % of (Mg and/or P), and the balance of Cu, wherein the sum of Ni and Co is between 2.0 and 4.0 wt %.

6. The process for preparing copper alloy according to claim 4 which further comprises the step of subjecting said copper alloy plate to additional cold rolling after aging.

* * * * *